US007134900B2

(12) United States Patent
Chung

(10) Patent No.: US 7,134,900 B2
(45) Date of Patent: Nov. 14, 2006

(54) ELECTRICAL CONNECTOR ASSEMBLY WITH MULTI-FUNCTION LATCHING MEMBER

(75) Inventor: Yung-Chien Chung, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/401,082

(22) Filed: Apr. 10, 2006

(65) Prior Publication Data

US 2006/0228946 A1 Oct. 12, 2006

(30) Foreign Application Priority Data

Apr. 8, 2005 (CN) ..... 2005 2 0070596

(51) Int. Cl.
*H01R 13/627* (2006.01)

(52) U.S. Cl. ..... 439/353

(58) Field of Classification Search ..... 439/353, 439/350, 357, 354, 953
See application file for complete search history.

(56) References Cited

U.S. PATENT DOCUMENTS 4,787,860 A 11/1988 Bender
5,197,901 A * 3/1993 Hashiguchi ..... 439/352
6,071,141 A 6/2000 Semmeling et al.
6,540,542 B1 * 4/2003 Simmel ..... 439/352
6,997,733 B1 * 2/2006 Peng ..... 439/353
7,033,218 B1 * 4/2006 Huang et al. ..... 439/607

* cited by examiner

*Primary Examiner*—Phuong Dinh
(74) *Attorney, Agent, or Firm*—Wei Te Chung

(57) ABSTRACT

An electrical connector assembly (1) includes a first connector (10), a second connector (20) and latching mean. The first connector includes a first housing (100), a number of first terminals (160) received in the first housing and a first shell (130, 140). The second connector includes a second housing (200), a number of second terminals (260) received in the second housing and a second shell (240). The latching mean includes a latching member (150) assembled on the first connector and a gap defined on the second connector. The latching member includes a pair of arms (151, 153), a connecting portion (157) connecting the arms, and a latching section (152) formed on the arm and received in the gap (245) of the second connector. The face of the latching section close to the connecting portion is inclined.

10 Claims, 8 Drawing Sheets

ELECTRICAL CONNECTOR ASSEMBLY WITH MULTI-FUNCTION LATCHING MEMBER

BACKGROUND OF THE INVENTION

1. Field of the Invention

The present invention generally relates to an electrical connector assembly, and more particularly to an electrical connector assembly with latching member.

2. Description of Prior Art

Normally, latching means are needed between a plug electrical connector and a receptacle connector for ensuring engagement there between and the signals transmission. The common latching means comprise active latching means and passive latching means. The active latching means relate to a latching member requires an additional pressure exerted thereon, when separating the plug and receptacle connector. This type of latching mean needs a bigger space for person making a force on the latching member. However, as the connector becomes more and more miniature, the space left for operator becomes more and more slight. So, the passive latching means are developed. The passive latching means relate to a person can separate a plug and receptacle connector by dragging the plug connector directly, and needn't a force working on the latching member directly. However, in some applications, both active and passive means are required.

Hence, it is desirable to have an improved connector with latching member to overcome the above-mentioned disadvantages of the prior art.

BRIEF SUMMARY OF THE INVENTION

Accordingly, the object of the present invention is to provide an electrical connector with high durability cycles.

In order to achieve the above-mentioned object, an electrical connector assembly comprises a first connector, a second connector and latching mean, the first connector comprises a first housing, a first terminals received in the first housing and a first shell; the second connector comprises a second housing, a second terminals received in the second housing and a second shell; the latching mean comprises a latching member assembled on the first connector and a gap defined on the second connector; the latching member comprises a pair of arms, a connecting portion connecting the arms, and a latching section formed on the arm and received in the gap of the second connector, a face of the latching section closed to the connecting portion is inclined.

Other objects, advantages and novel features of the invention will become more apparent from the following detailed description of the present embodiment when taken in conjunction with the accompanying drawings.

DETAILED DESCRIPTION OF THE INVENTION

Figure 1:
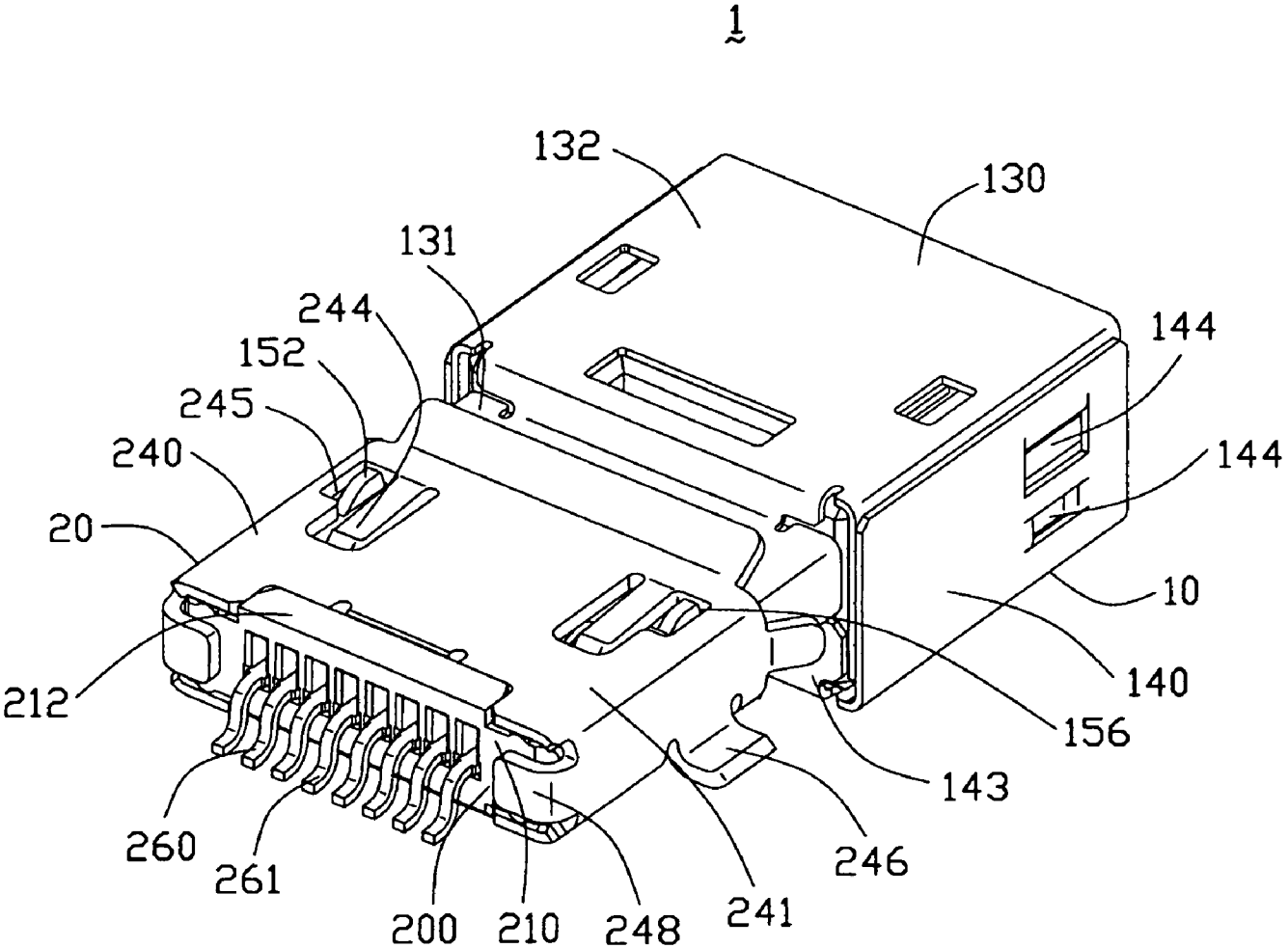
FIG. 1 is an assembled perspective view of an electrical connector assembly in accordance with the present invention.
Figure 2:
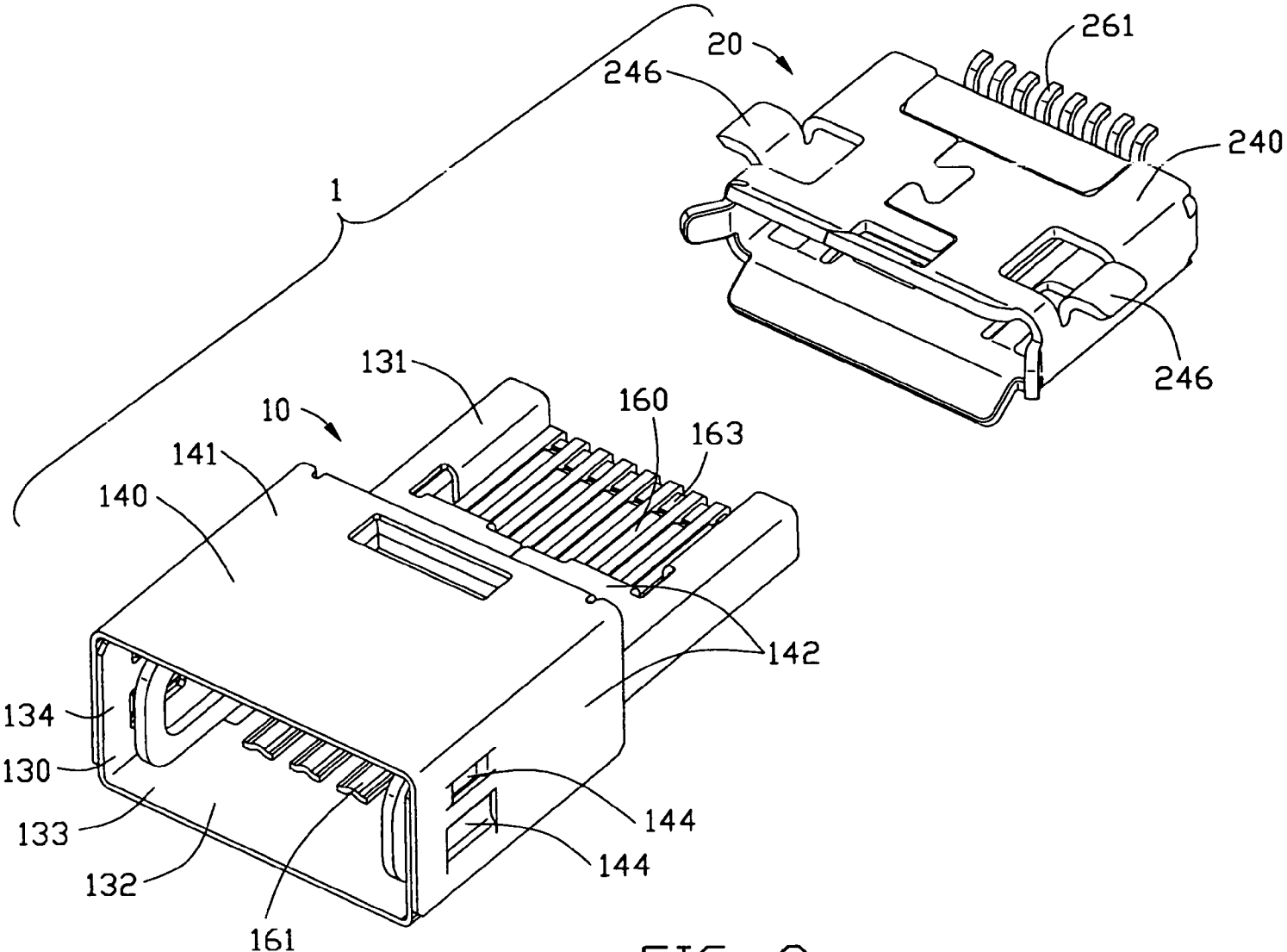
FIG. 2 is a perspective view of separated first and second connector of the electrical connector assembly.
Figure 3:
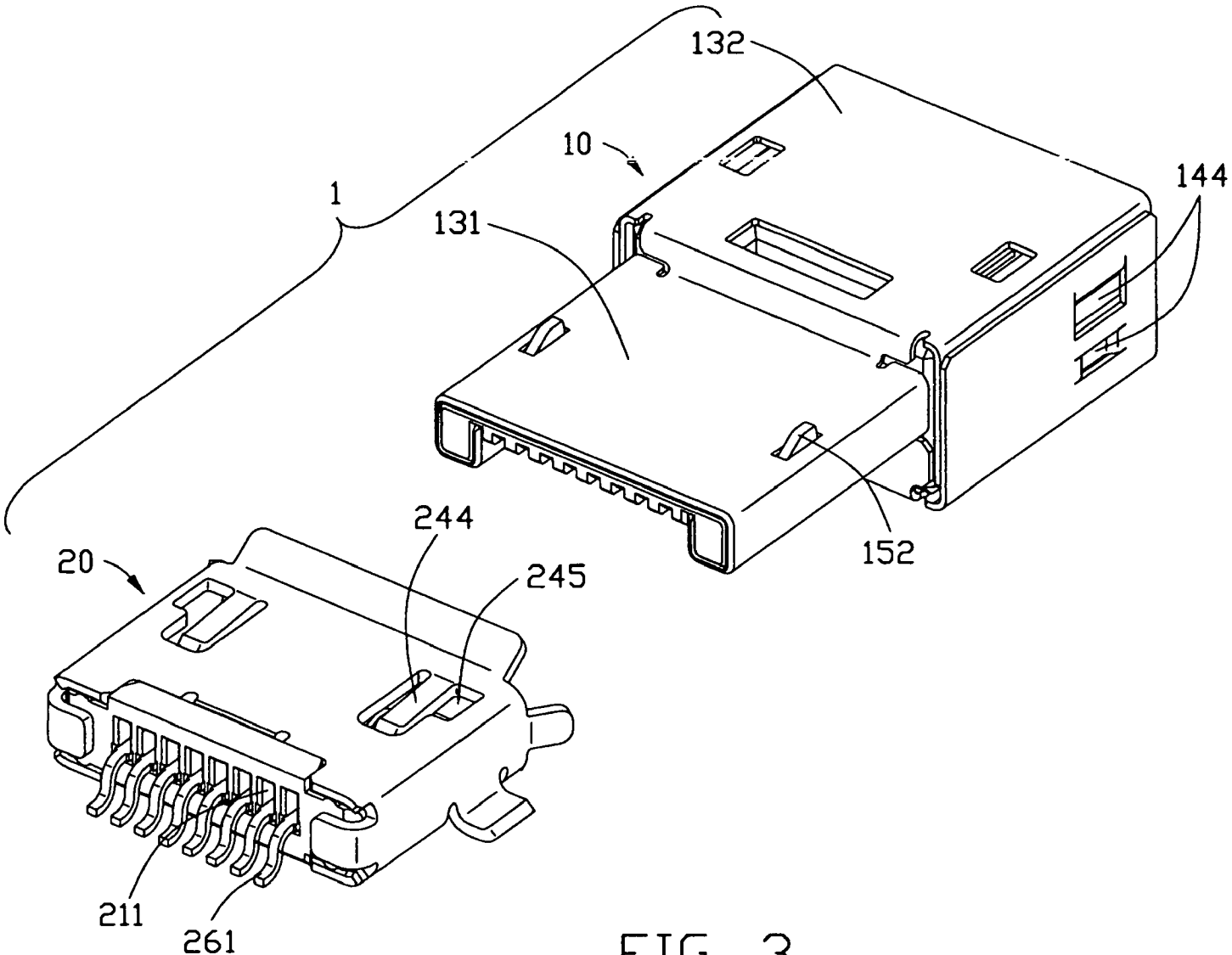
FIG. 3 is a view similar to FIG. 2, but taken from a different aspect.
Figure 4:
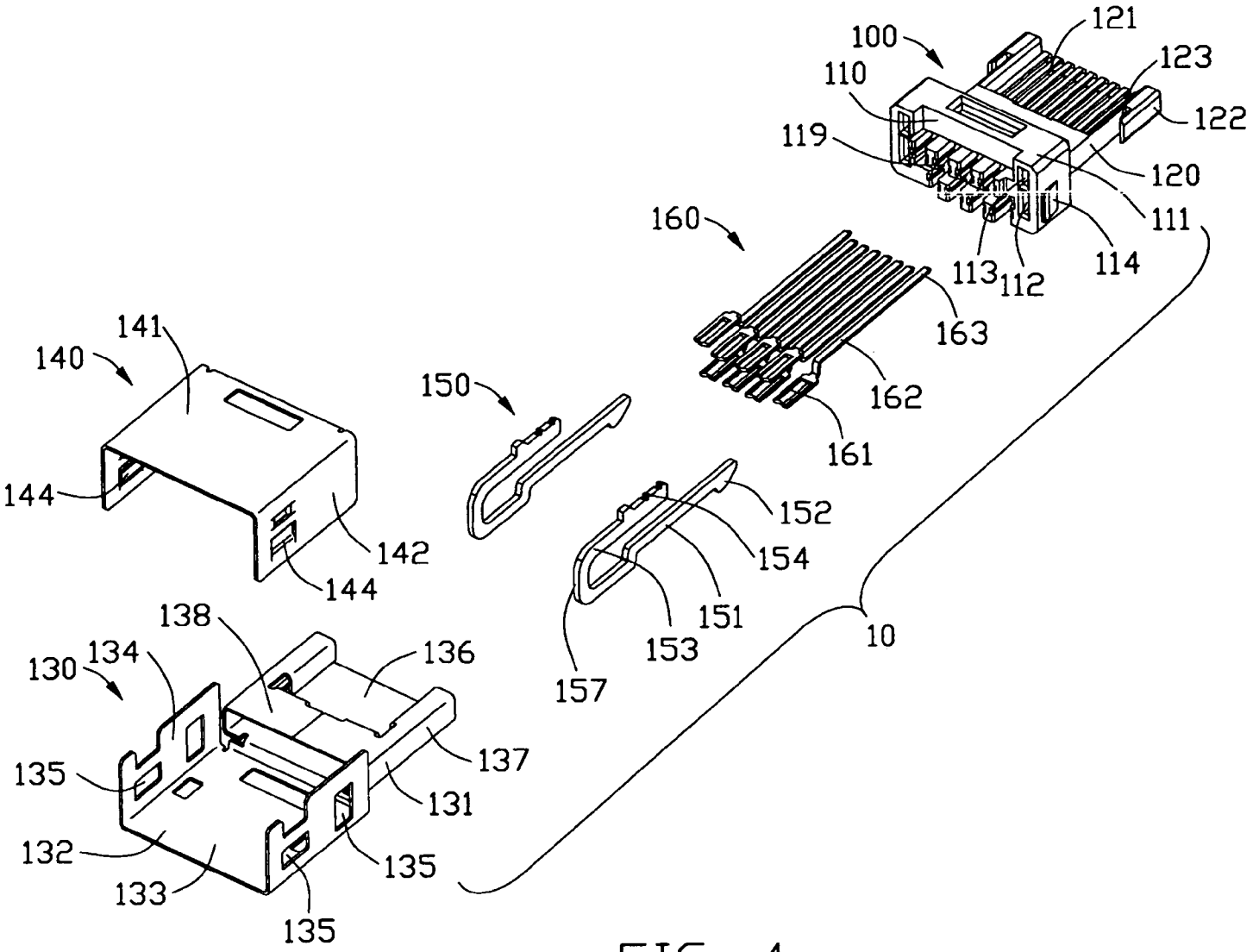
FIG. 4 is an exploded, perspective view of the first electrical connector shown in FIG. 2.

Reference will now be made to the drawing figures to describe the present invention in detail.

Referring to FIG. 1, an electrical connector assembly 1 in accordance with the present invention comprises a first connector 10 and a second connector 20.

Viewing FIGS. 2 to 6, the first connector 10 comprises a first housing 100, a plurality of first terminals 160 received in the housing 100, an upper cover 130 and a bottom cover 140, and a pair of latching members 150. The upper cover 130 and the bottom cover 140 enclose the first housing 100 together.

The first housing 100 comprises a base portion 110 and a tongue 120 extending from the base portion 110. The base portion 110 comprises a pair of end portions 111 at opposite ends thereof, and a plurality of receiving passages 119 extending through the base portion 110. Each end portion 111 comprises an upper channel 112 and a bottom channel 113 extending through the base portion 110 in stack-relation ship, and a locking block 114 on the outer face thereof. The tongue 120 defines a plurality of receiving slits 121 communicating with corresponding receiving passages 119, and a pair of projections 122 formed at opposite sides of front end thereof. A narrow slot 123 is defined between projection 122 and the tongue 120.

Each first terminal 160 comprises a tail portion 161, a straight portion 162 and a contacting portion 163. The tail portion 161 extends upwardly or downwardly from the straight portion 162, and then flatly extends for electrically connecting with wires (not shown).

Both the upper cover 130 and the bottom cover 140 are made of metal material. The bottom cover 140 comprises a bottom plate 141, a pair of lateral plates 142 extending upwardly from opposite sides of the bottom plate 141, and front plate 143 bent downwardly from the front side of the upper plate 141. Each lateral plate 142 comprises a plurality of inwardly-protruding engaging pieces 144. The upper cover 130 comprises a pair of rectangle holes 1301, a front portion 131 and a rear portion 132. The rear portion 132 comprises an upper plate 133 and a pair of downwardly extending lateral walls 134. Each lateral wall 134 comprises a plurality of engaging cutouts 135. The front portion 131 comprises a panel 136 and a pair of side wings 137 is extending downwardly from opposite sides thereof. A rear end of each wing 137 bent to form a covering portion 138. A pair of passageways 139 are defined at opposite sides. The panel 136 comprises a pair of receiving holes 1361 thereon.

Figure 8:
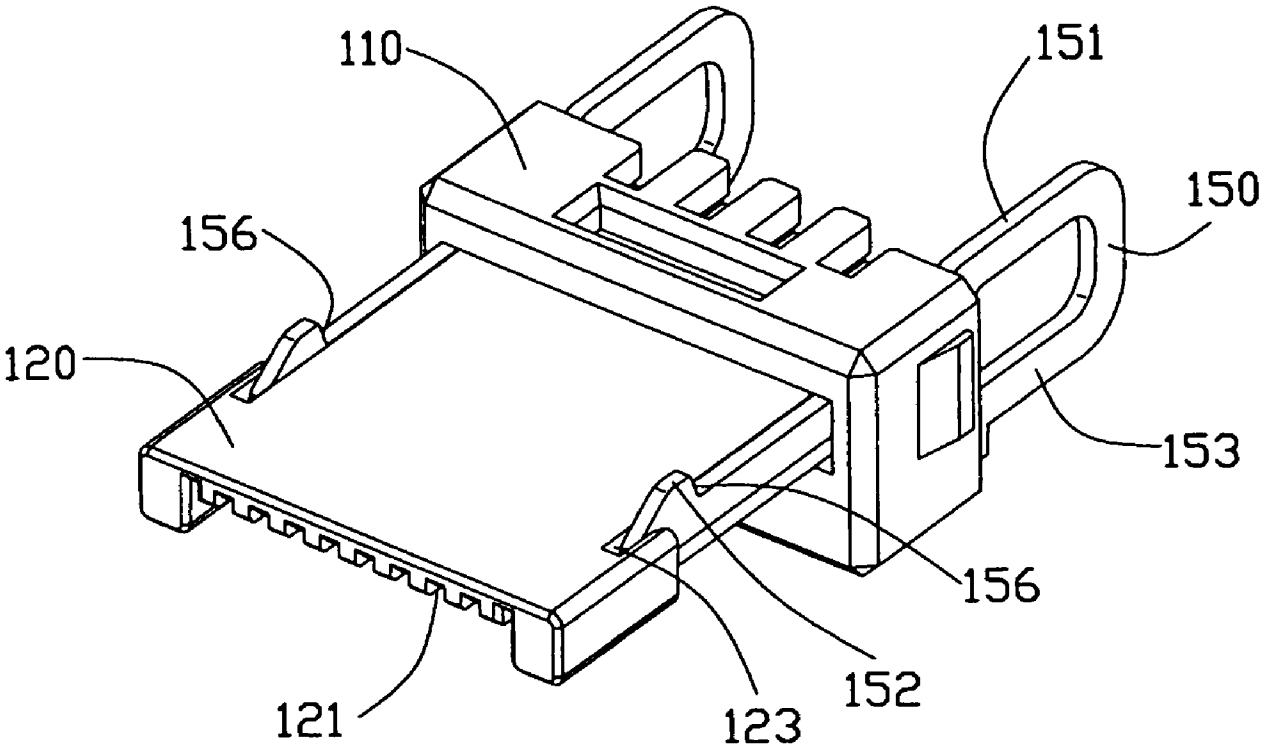
FIG. 8 is a view similar to FIG. 7, but taken from a different aspect.

Each latching member 150 comprises a first arm 151 and a second arm 153, and an U-shape connecting portion 157 connecting the first and the second arms 151, 153 in the vertical direction. The first arm 151 forms a tapered latching section 152 at the distal end thereof. The face of the latching section 152 towards the connecting portion 151 is formed with a slightly inclined surface 156 (shown in FIG. 8). The second arm 153 forms a plurality of retaining barbs 154 thereof.

During assembly, the first terminals 160 are inserted into corresponding receiving passages 119, and the tail portions 161 are exposed beyond the housing 100 for terminating to the wires, the contacting portions 163 extend into the slits 121 of the tongue 120. The first arm 151 and the second arm 153 of each latching member 150 is inserted into the upper and lower channels 112, 113, respectively. The first arm 151 extends through the base portion 110 of the housing 100 and slides along outer side surface of the tongue 120 until the latching section is received into the narrow slot 123. The retaining blocks 154 of second arm 153 engage with the inner faces of the upper channel 112. The first housing 100 is inserted into the upper cover 130 along a front-to-back direction. The base portion 110 is positioned at the rear portion 132 with the locking blocks 114 are received in corresponding engaging cutouts 135 of the lateral walls 134. The tongue 120 is positioned on the front portion 131 with the projections 122 are inserted into the passageways 139 of the front portion 131. The bottom cover 140 is assembled with the rear portion 132 of the upper cover 130. The engaging plates 144 are engaging with corresponding engaging cutouts 135, respectively. The tail portions 161 of the first terminals 160 electrically connect with cable (not shown).

Figure 5:
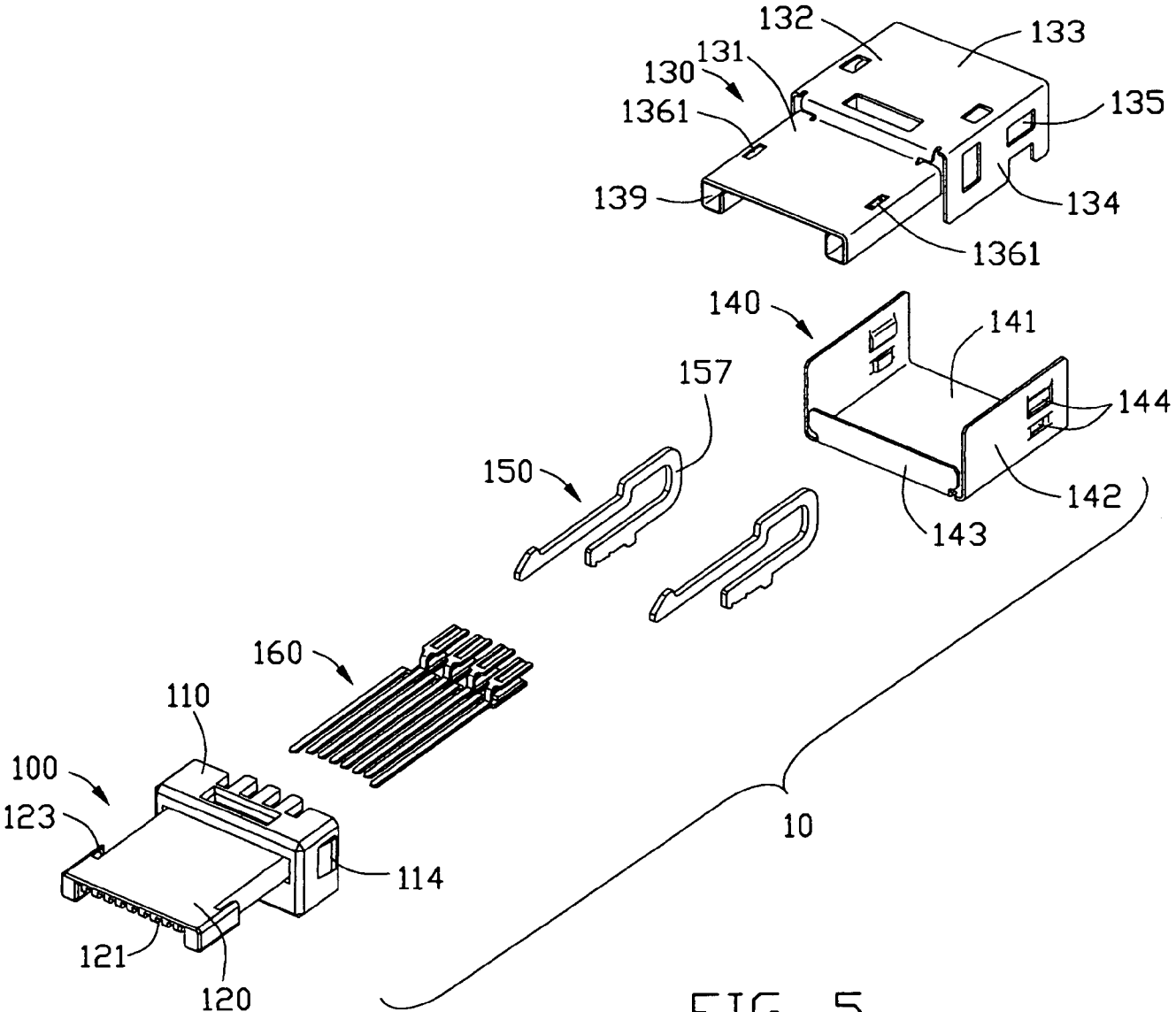
FIG. 5 is a view similar to FIG. 4, but taken from a different aspect.
Figure 6:
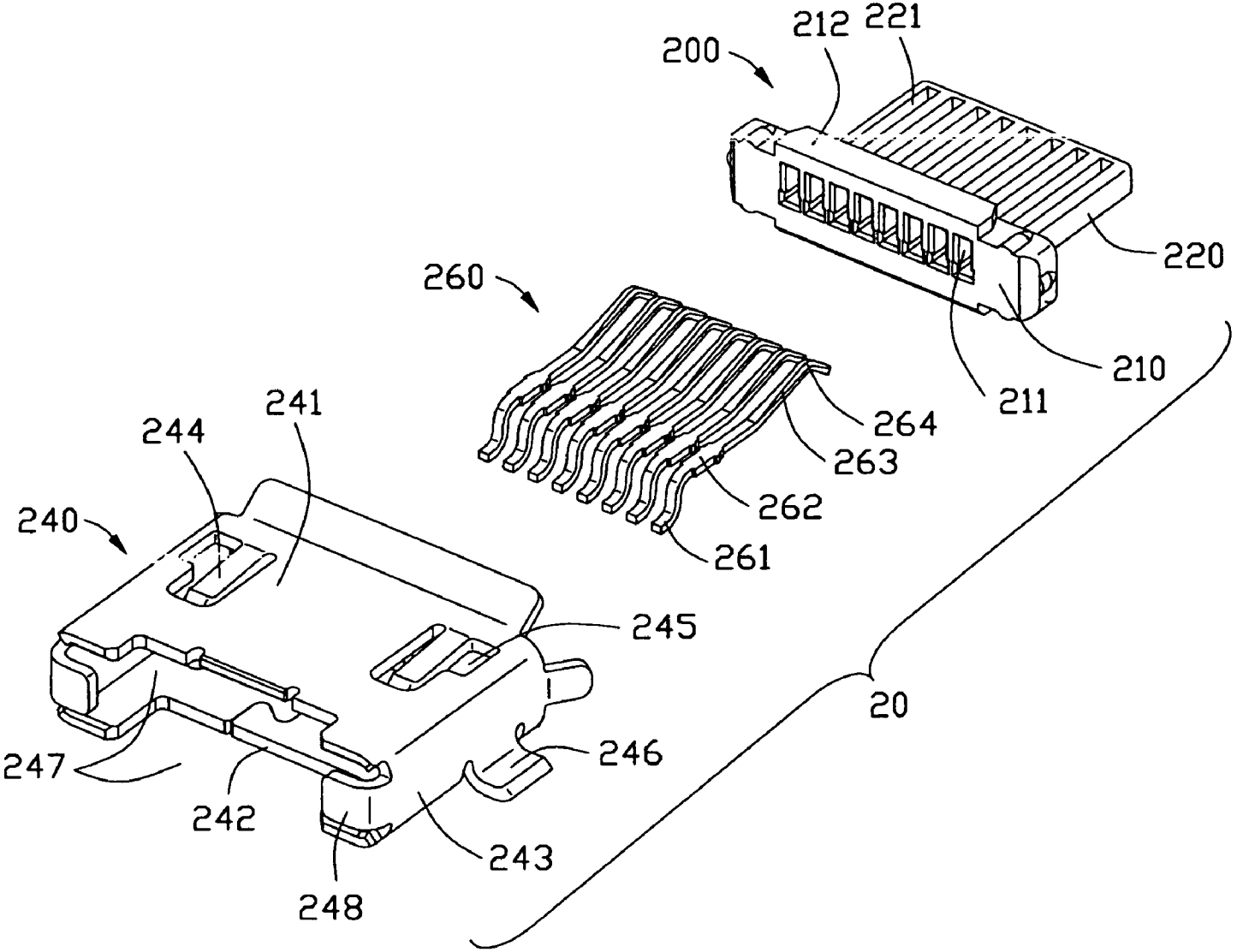
FIG. 6 is a perspective view of a latching member assembled on first housing of the first connector.
Figure 7:
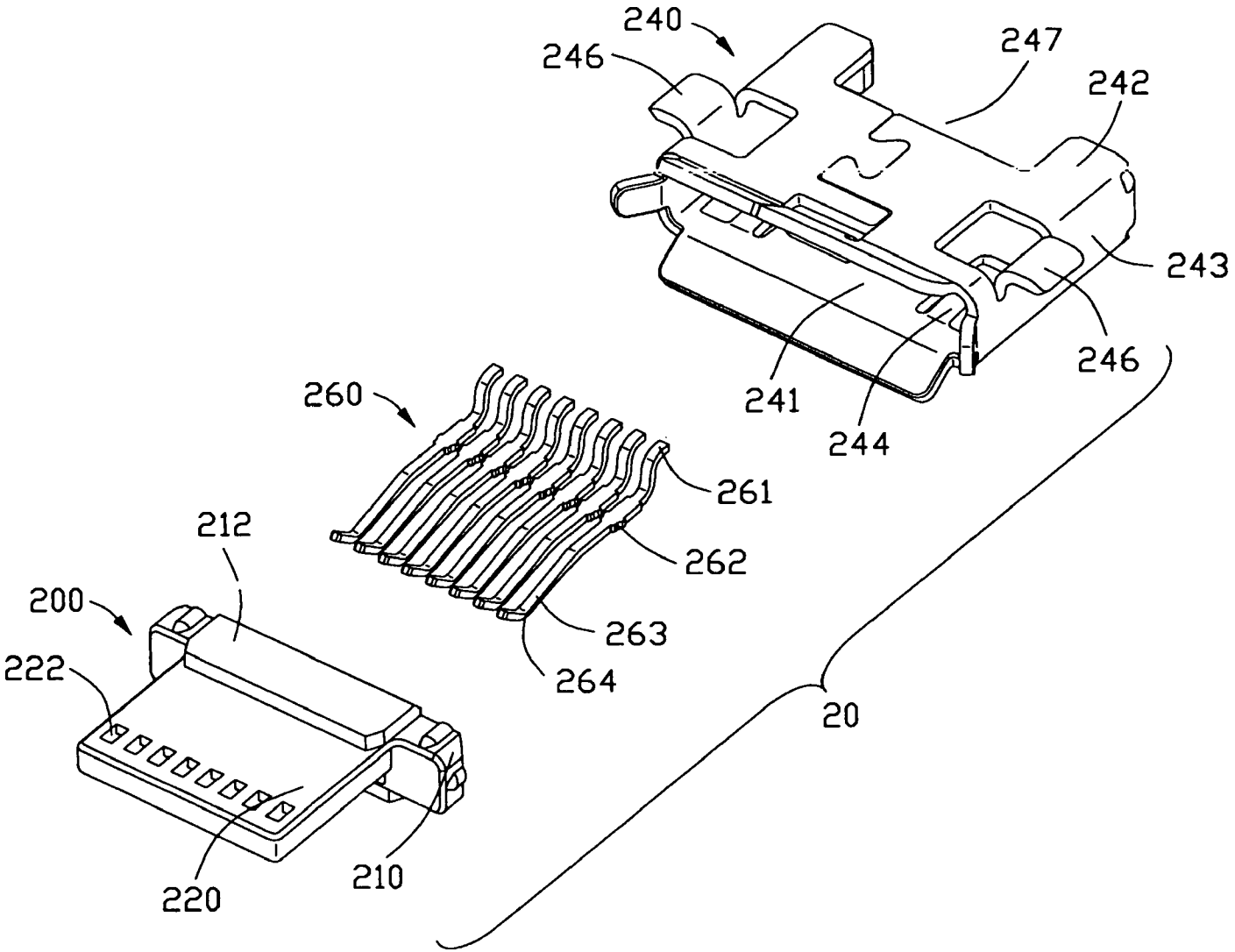
FIG. 7 is an exploded, perspective view of the second electrical connector shown in FIG. 2.

Referring to FIG. 5 and FIG. 6, the second connector 20 comprises a second housing 200, a plurality of second terminals 260 received in the second housing 200, and a second shell 240 enclosing the second housing 200. The second housing 200 comprises a main body 210 and a tongue portion 220. The main body 210 comprises a pair of stopping blocks 212 extending upwardly and downwardly, respectively, and a plurality of terminal passages 211 extending through the main body 210. The tongue portion 220 comprises a plurality of slits 221 communicating with corresponding terminal passages 211. The tongue portion 220 also defines a pair of holes 222 at the front part, and the holes 222 pass through the tongue portion 220 vertically to communicate with corresponding 221. The second terminal 260 comprises a retaining portion 262, a mounting portion 261 extending downwardly from the retaining portion 262, a contacting portion 263 extending forwardly from the retaining portion 262, and a curved portion 264 formed at the front thereof. The second shell 240 is made of metal material, and comprises a top plate 241, a bottom plate 242 and a pair of side plates 243 connecting the top and the bottom plate 241, 242. The top plate 241 defines a pair of gaps 245 and a pair of engaging tabs 244 bent downwardly into the gaps 245, respectively. Rear portions of the upper plate 241 and the bottom plate 242 each defines a depression 247. The lateral plates 243 form a pair of projecting plate 248 bent toward each other. The second shell 240 and the tongue portion 240 define a receiving space (not labeled) together.

When the second connector 20 assembled, the second terminals 260 are inserted into the second housing 200. The retaining portion 262 of each second terminal 260 is retained in the terminal passage 211, the mounting portion 161 is exposed out of the second housing 200 for mounting to a PCB, and the contacting portion 263 is positioned in the slit 221 of the tongue portion 220. The curved portion 264 of the second terminal 260 extends into the hole 222 of the tongue portion 220. Then, the second housing 200 is inserted into the second shell 240 along the front-to-back direction. The stopping blocks 212 of the second housing 200 abut the rear edges of the depressions 247 of second shell 240, and the projecting plates 248 are bent to resist the rear face of second housing 200. Thereby, the second housing 200 is locked in the second shell 240.

While the first connector 10 is inserted into the second connector 20 to a locking position, both the tongue 120 and the front portion 131 of the upper shell 130 of the first connector 10 extend into the receiving space (not labeled) of the second connector 20. The tongue 120 of the first connector 10 is overlapped on the tongue portion 220 of the second connector 20, with the contacting portions 163, 263 of the first and second terminals 160, 260 electrically connecting with each other. The latching section 152 of the latching member 150 are received into the gap 245 beside corresponding engaging bars 244 of the second shell 240.

The first connector 10 is enclosed by insulative material (not shown), and defines a pressing portion (not shown) can work on the latching member 150. An operator can press the pressing portions to move the bars downwardly and to separate the first and the second connector 10, 20. Also, the operator can directly pull the first connector 10 out of the second connector 20 because of the existence of the inclined surface 156 on the latching section 152 of the latching member.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

a first connector comprising a first housing, a plurality of first terminals received in the first housing and a first shell;

a second connector comprising a second housing, a plurality of second terminals received in the second housing and a second shell;

latching means comprise a latching member assembled on the first connector and a gap defined on the second connector;

the latching member comprising a pair of arms, a connecting portion connecting with the arms, and a latching section formed on the arm and received in the gap of the second connector, a face of the latching section close to the connecting portion is inclined and engaging to an edge of the gap; wherein the first housing comprises a base portion and a tongue extending from the base portion, the base portion comprises an upper channel and a lower channel, the arms of the latching member are received in the upper and the lower channels, respectively; wherein the tongue forms a projection at the front end thereof, and a slot formed between the projection and the tongue, and said latching member extends into the slot with the latching section exposed beyond the tongue; wherein the other arm defines a plurality of retaining blocks engaging with the inner face of the upper channel; wherein the base portion has a plurality of terminal passages, and the tongue defines a plurality of slits communicating with the terminal passages; wherein the first terminal comprises a tail portion, a straight portion and a contacting portion at the front of the straight portion, and wherein the tail portion is exposed out of the housing, and the contacting portion is positioned in the slit of the tongue.

2. The electrical connector assembly as claimed in claim 1, wherein the first shell comprises an upper shell and a bottom shell assembled with each other to enclose the first housing of first terminals.

3. The electrical connector assembly as claimed in claim 2, wherein the first shell has a rectangle hole for the latching section of the latching member passing through.

4. The electrical connector assembly as claimed in claim 1, wherein the second housing comprises a main body and a tongue portion extending from the main body, the main body has a plurality of terminal passages, and the tongue portion defines a plurality of slits communicating with the terminal passages, the terminal passages defines a hole at the front thereof.

5. The electrical connector assembly as claimed in claim 3, wherein the second terminal comprises a retaining portion, a mounting portion extending downwardly from the retaining portion and a contacting portion extending from the retaining portion, the contacting portion bent to a curved portion at the front thereof, and wherein the retaining portion is retained in corresponding terminal passage, the mounting portion is exposed out of the second housing, and the contacting portion is positioned in the slit with the curved portion extending into the hole.

6. The electrical connector assembly as claimed in claim 3, wherein the first connector and the first shell extend into the second connector, the tongue of the first connector is overlapped on the tongue portion of the second connector, with corresponding pair of contacting portions of the first and second terminals electrically connecting with each other.

7. The electrically connector assembly as claimed in claim 1, wherein the first connector electrically connects with a cable, and the second connector electrically connects with a printed circuit board.

8. The electrically connector assembly as claimed in claim 1, wherein the connecting portion connects the arms along a up-to-down direction, and the arms is parallel with each other.

9. An electrical connector comprising:

an insulative housing defining a blade with an upper face;

a plurality of contacts disposed in the housing;

a metallic shield covering said housing, and including an upper wall essentially shielding said upper face with an opening therein; and a pair of latch members located on two opposite sides of the housing and up-and-down deflectable relative to the housing; wherein each of said latch members includes a locking head upwardly extending beyond said upper face and through said opening to be exposed to an exterior; wherein a pair of projections are formed at two opposite sides of the blade and a narrow slot is formed between each corresponding projection and the blade to protectively hold the corresponding locking head therein; wherein the metallic shield further includes a pair of side wings extending downwardly from two opposite sides of the upper wall with therein a pair of passageways defined at said opposite sides; wherein the passageways snugly receive the corresponding projections, respectively, and further enclose the corresponding latch members.

10. An electrical connector assembly comprising:

a first connector and a second connector matable with each other, said first connector including:

a first insulative housing;

a plurality of first contacts disposed in the first housing;

a first metallic shield covering said first housing, and including a first exterior wall with a first opening therein;

at least one latch member up-and-down deflectable relative to the first housing, said latch member including a pair of arms;

the second connector including a second housing;

a plurality of second contacts disposed in the second housing;

a second metallic shield covering said second housing and defining a second exterior wall with a second opening therein;

wherein when the first and second connectors are mated with each other, said second metallic shield encloses said first metallic shield under a condition that said latch member includes a locking head upwardly extending through both said first and second openings; wherein the first housing comprises a base portion and a tongue extending from the base portion, the base portion comprises an upper channel and a lower channel, the arms of the latching member are received in the upper and the lower channels, respectively; wherein the tongue forms a projection at the front end thereof and a slot formed between the projection and the tongue, and said latching member extends into the slot with the latching section exposed beyond the tongue; wherein the other arm defines a plurality of retaining blocks engaging with the inner face of the upper channel; wherein the base portion has a plurality of terminal passages, and the tongue defines a plurality of slits communicating with the terminal passages; wherein the first terminal comprises a tail portion, a straight portion and a contacting portion at the front of the straight portion, and wherein the tail portion is exposed out of the housing, and the contacting portion is positioned in the slit of the tongue.

* * * * *